US010475607B2

(12) United States Patent
Jimbo et al.

(10) Patent No.: US 10,475,607 B2
(45) Date of Patent: Nov. 12, 2019

(54) GAS CIRCUIT BREAKER

(71) Applicant: Kabushiki Kaisha Toshiba, Tokyo (JP)

(72) Inventors: Tomohiko Jimbo, Fujisawa Kanagawa (JP); Biswas Debasish, Shiki Saitama (JP); Amane Majima, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/893,733

(22) Filed: Feb. 12, 2018

(65) Prior Publication Data

US 2019/0088430 A1 Mar. 21, 2019

(30) Foreign Application Priority Data

Sep. 15, 2017 (JP) ..... 2017-178355

(51) Int. Cl.
*H01H 33/70* (2006.01)
*H01H 33/56* (2006.01)
(Continued)

(52) U.S. Cl.
CPC ..... *H01H 33/7023* (2013.01); *H01H 33/56* (2013.01); *H01H 33/88* (2013.01);
(Continued)

(58) Field of Classification Search
CPC .... H01H 33/56; H01H 33/7023; H01H 33/74; H01H 33/82; H01H 33/88; H01H 73/00
(Continued)

(56) References Cited

U.S. PATENT DOCUMENTS 5,793,597 A * 8/1998 Mizufune ..... H01H 33/7015 361/116
6,660,954 B2 * 12/2003 Iwabuchi ..... H01H 33/91 218/52
(Continued)

FOREIGN PATENT DOCUMENTS

JP 2000-222987 8/2000
JP 2000-294095 10/2000
(Continued)

*Primary Examiner* — Truc T Nguyen
*Assistant Examiner* — William A Bolton
(74) *Attorney, Agent, or Firm* — Finnegan, Henderson, Farabow, Garrett & Dunner, L.L.P.

(57) ABSTRACT

In a gas circuit breaker, arc-extinguishing gas is filled in a container. A movable portion housed in the container includes a movable arc contact. The movable portion includes a pressure accumulator that increases pressure of an arc-extinguishing gas. An opposing portion housed in the container includes an opposing arc contact, an exhaust pipe, and a shielding portion. The shielding portion includes a first shielding wall intersecting with an axial direction of the pipe and a second shielding wall having a cylindrical shape extending from the first shielding wall toward the movable portion along the axial direction of the pipe. The second shielding wall includes through-holes. Lengths of the respective through-holes along the axial direction are from 18 millimeter's to 55 millimeters inclusive. An arc-extinguishing gas whose pressure has been increased in the pressure accumulator flows into a space to extinguish arc discharge, and flows into the second shielding wall.

8 Claims, 8 Drawing Sheets

(51) Int. Cl.

| | |
|---|---|
| ***H01H 33/74*** | (2006.01) |
| ***H01H 33/88*** | (2006.01) |
| ***H01H 33/90*** | (2006.01) |
| ***H01H 33/91*** | (2006.01) |

(52) U.S. Cl.
CPC ..... *H01H 33/74* (2013.01); *H01H 33/901* (2013.01); *H01H 33/91* (2013.01); *H01H 2033/888* (2013.01)

(58) Field of Classification Search
USPC ..... 218/51, 52, 57, 59–63, 65, 53
See application file for complete search history.

(56) References Cited

U.S. PATENT DOCUMENTS

| | | | | |
|---|---|---|---|---|
| 8,674,253 | B2 * | 3/2014 | Uchii | H01F 27/321 218/59 |
| 8,779,316 | B2 * | 7/2014 | Drews | H01H 33/74 218/51 |
| 8,895,883 | B2 | 11/2014 | Akesson | |
| 2007/0068904 | A1 | 3/2007 | Dahlquist et al. | |
| 2015/0014280 | A1 * | 1/2015 | Cernat | H01H 33/91 218/157 |
| 2015/0170858 | A1 | 6/2015 | Kotsuji et al. | |
| 2016/0379780 | A1 | 12/2016 | Jimbo et al. | |

FOREIGN PATENT DOCUMENTS

| | | |
|---|---|---|
| JP | 2007-035518 | 2/2007 |
| JP | 2012-069348 | 4/2012 |
| JP | 2014-89899 | 5/2014 |
| JP | 2014-525119 | 9/2014 |
| JP | 2015-011875 | 1/2015 |
| JP | 2017-16797 | 1/2017 |

* cited by examiner

GAS CIRCUIT BREAKER

CROSS-REFERENCE TO RELATED APPLICATIONS

This application is based upon and claims the benefit of priority from Japanese Patent Application No. 2017-178355, filed on Sep. 15, 2017; the entire contents of which are incorporated herein by reference.

FIELD

Embodiments described herein relate generally to a gas circuit breaker.

BACKGROUND

A conventionally known gas circuit breaker has two contact portions constituting an electrical circuit, and arc discharge generated between the two contact portions is extinguished by spraying an arc-extinguishing gas.

This type of gas circuit breaker is significant, for example, if arc discharge can be extinguished more smoothly or more reliably.

DETAILED DESCRIPTION

According to an embodiment, a gas circuit breaker includes, for example, a container, a movable portion, an opposing portion, and a nozzle. The container is filled with an arc-extinguishing gas. The movable portion is housed in the container, and includes a movable arc contact. The movable portion is provided with a pressure accumulator that increases pressure of an arc-extinguishing gas. The opposing portion is housed in the container, and includes an opposing arc contact, an exhaust pipe, and a shielding portion provided in the exhaust pipe in a state of allowing flow of an arc-extinguishing gas in the exhaust pipe. The nozzle is housed in the container. The nozzle is provided with a space in which arc discharge is generated between the movable arc contact and the opposing arc contact. The shielding portion includes a first shielding wall intersecting with an axial direction of the exhaust pipe, and a second shielding wall having a cylindrical shape extending from the first shielding wall toward the movable portion along the axial direction of the exhaust pipe. The second shielding wall is provided with a plurality of through-holes with a space therebetween along the axial direction. The length of each of the through-holes along the axial direction is from 18 millimeters to 55 millimeters inclusive. An arc-extinguishing gas whose pressure has been increased in the pressure accumulator flows into the space to extinguish the arc discharge, and flows into the second shielding wall.

Exemplary embodiments of the present invention will be disclosed below. Configurations and control (technical characteristics) of the embodiments described below, and operations and results (effects) due to the configurations and control are only examples.

Figure 1:
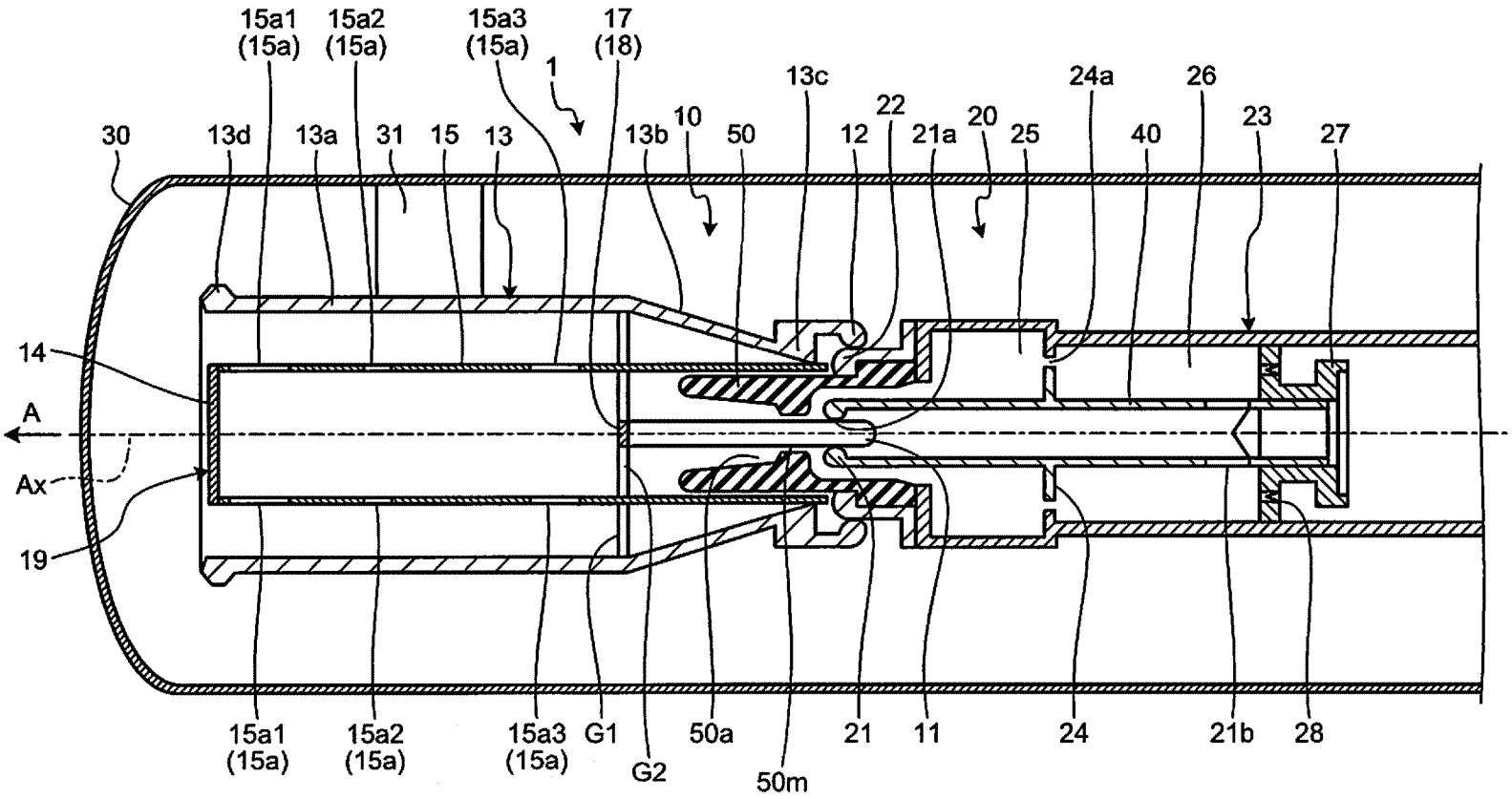
FIG. 1 is a sectional view schematically and exemplarily illustrating a gas circuit breaker along an axial direction according to an embodiment, illustrating a connected state thereof.
Figure 2:
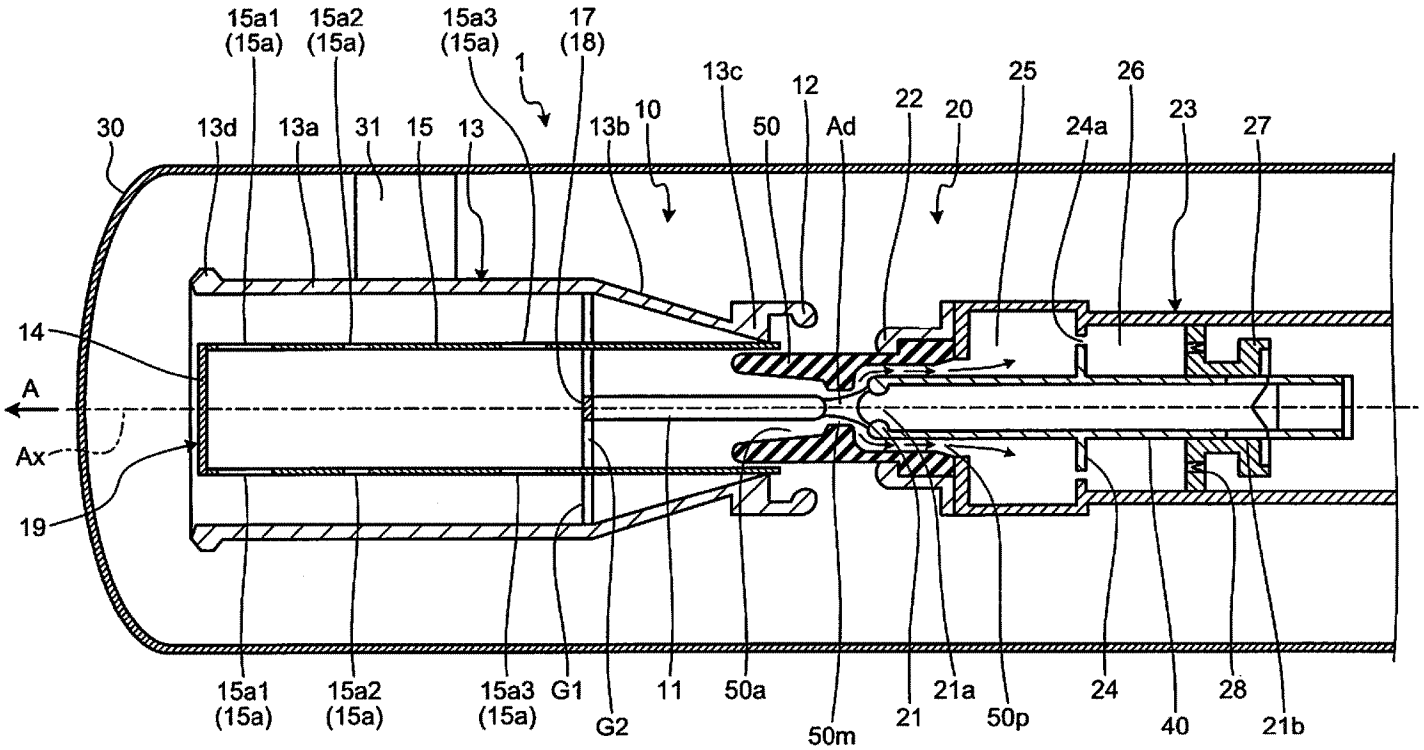
FIG. 2 is a sectional view schematically and exemplarily illustrating the gas circuit breaker along an axial direction according to the embodiment, illustrating an open state thereof subsequent to the state in FIG. 1.
Figure 3:
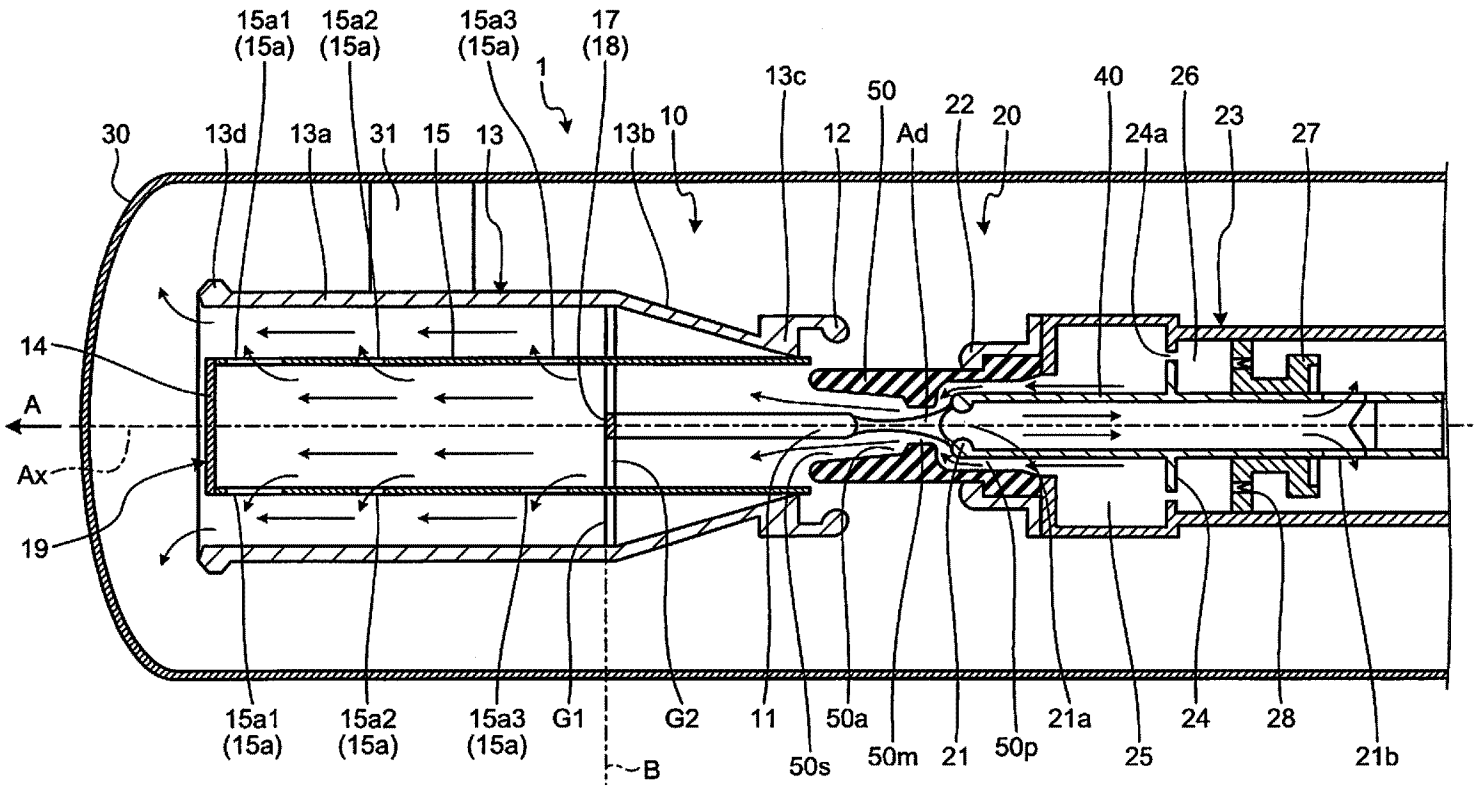
FIG. 3 is a sectional view schematically and exemplarily illustrating the gas circuit breaker along an axial direction according to the embodiment, illustrating an open state thereof further subsequent to the state in FIG. 2.

As illustrated in FIGS. 1 to 3, a gas circuit breaker 1 includes an opposing contact portion 10 and a movable contact portion 20 as two contact portions that constitute an electrical circuit. In the gas circuit breaker 1, a connected state in which the opposing contact portion 10 and the movable contact portion 20 are brought into contact with each other (FIG. 1) is switched with an open state in which the opposing contact portion 10 and the movable contact portion 20 are separated from each other (FIGS. 2 and 3). In the open state subsequent to the connected state, arc discharge is generated between the opposing contact portion 10 and the movable contact portion 20. By spraying arc-extinguishing gas to the arc discharge, the arc discharge is insulated and cooled, and is extinguished at a current zero point, to interrupt the current. The connected state is also referred to as "contact state", and the open state can be also referred to as "separated state".

As illustrated in FIG. 1, the gas circuit breaker 1 includes an airtight container 30. An arc-extinguishing gas is filled in the airtight container 30. The airtight container 30 is configured by for example a metal material or glass and is connected to the ground. The airtight container 30 is an example of a container.

The arc-extinguishing gas is a gas exhibiting excellent arc extinguishing performance and insulation performance, for example, sulfur hexafluoride gas (SF6 gas), air, carbon dioxide, oxygen, nitrogen, and a mixed gas thereof. The arc-extinguishing gas can be a gas, for example, having a global warming potential lower than the SF6 gas and a lower molecular weight than the SF6 gas, and being in a gas phase at at least 1 atmospheric pressure or higher and at a temperature of 20° C. or lower.

In the airtight container 30, the opposing contact portion 10 and the movable contact portion 20 are provided to face each other. The opposing contact portion 10 and the movable contact portion 20 include a plurality of cylindrical or columnar members and are provided concentrically around a central axis Ax. In the following descriptions, "axial direction" is an axial direction of the central axis Ax, "radial direction" is a radial direction of the central axis Ax, and "circumferential direction" is a circumferential direction of the central axis Ax. The opposing contact portion 10 is an example of an opposing portion, and the movable contact portion 20 is an example of a movable portion. In the following descriptions, for convenience sake, the side of the opposing contact portion 10 in the axial direction, that is, the left side in FIGS. 1 to 3 is referred to as "axial direction A", the side of the movable contact portion 20 in the axial direction, that is, the right side in FIGS. 1 to 3 is referred to as "the other side of the axial direction A". In the present embodiment, because the opposing contact portion 10 is fixed to the airtight container 30, the opposing contact portion 10 is also referred to as "fixed contact portion".

A support member 31 projects from an inner surface of the airtight container 30 inward in the radial direction. The opposing contact portion 10 is fixed to the airtight container 30 via the support member 31. The support member 31 insulates between the airtight container 30 and the opposing contact portion 10. Accordingly, the support member 31 is also referred to as "insulation support member".

The movable contact portion 20 is connected to an operating rod 40. The operating rod 40 is formed in a cylindrical shape extending along the axial direction A around the central axis Ax, and is configured to be capable of reciprocating along the central axis Ax. The operating rod 40 is moved along the axial direction A by a drive system (not illustrated). The movable contact portion 20 moves in the axial direction A in association with the operating rod 40. When the operating rod 40 moves in a direction approaching the opposing contact portion 10, that is, moves in the axial direction A, as illustrated in FIG. 1, the opposing contact portion 10 and the movable contact portion 20 become a connected state. When the operating rod 40 moves in a direction away from the opposing contact portion 10, that is, to the other side of the axial direction A, as illustrated in FIGS. 2 and 3, the opposing contact portion 10 and the movable contact portion 20 become an open state. The operating rod 40 also functions as a discharge pipe of an arc-extinguishing gas. That is, the arc-extinguishing gas can enter into the cylinder of the operating rod 40 from an end thereof in the axial direction A and pass through the cylinder to flow out into the airtight container 30 via an opening 21*b*.

The opposing contact portion 10 includes an opposing arc contact 11 and an opposing energizing contact 12. The movable contact portion 20 includes a movable arc contact 21 and a movable energizing contact 22. The opposing arc contact 11 and the movable arc contact 21 face each other in the axial direction A, and are electrically connected with each other in a connected state. The opposing energizing contact 12 and the movable energizing contact 22 face each other in the axial direction A, and are electrically connected with each other in a connected state. When the opposing contact portion 10 is fixed to the airtight container 30, the opposing arc contact 11 can be also referred to as "fixed arc contact", and the opposing energizing contact 12 can be also referred to as "fixed energizing contact".

The opposing arc contact 11 is a rod-like conductor, and extends along the axial direction A around the central axis Ax. A first shielding wall 14 having a disk shape being orthogonal to the axial direction A is provided in an exhaust pipe 13 of the opposing contact portion 10. A second shielding wall 15 having a cylindrical shape extending along the axial direction A is provided from the first shielding wall 14 toward the other side of the axial direction A.

The movable arc contact 21 is a cylindrical conductor, and extends along the axial direction A around the central axis Ax. According to the present embodiment, the movable arc contact 21 is integrated with the operating rod 40 as an example. A through-hole 21*a* having a circular shape is provided at the end of the movable arc contact 21 in the axial direction A. The end provided with the through-hole 21*a* is divided into a plurality of finger-like electrodes extending along the axial direction A by a plurality of slits (not illustrated) extending along the axial direction A. Ends of the finger-like electrodes are aligned along an edge having a diameter narrower than an outer periphery of the opposing arc contact 11. The movable arc contact 21 approaches the opposing arc contact 11 with movement of the operating rod 40, and as illustrated in FIG. 1, the opposing arc contact 11 is inserted into the through-hole 21*a*. Accordingly, the finger-like electrodes are pushed by the outer periphery of the opposing arc contact 11 and expanded outward in the radial direction, and brought into contact with the outer periphery of the opposing arc contact 11 by an elastomeric force of the finger-like electrodes.

Apical ends of the opposing arc contact 11 and the movable arc contact 21 are covered with an insulation nozzle 50 with a gap. The insulation nozzle 50 is formed of a material having heat resistance and insulation properties such as polytetrafluoroethylene. According to the present embodiment, as an example, the insulation nozzle 50 is fixed to the end of the movable contact portion 20 in the axial direction A, and moves integrally with the operating rod 40 and a cylinder 23 in the axial direction A. The insulation nozzle 50 has a cylindrical outer surface, and extends along the axial direction A around the central axis Ax. The insulation nozzle 50 is an example of a nozzle.

An opening 50*a* penetrating the insulation nozzle 50 in the axial direction A around the central axis Ax is provided in the insulation nozzle 50. As illustrated in FIG. 1, the opposing arc contact 11 can be inserted into a middle portion 50*m* of the opening 50*a* in the axial direction A with a gap therebetween. The middle portion 50*m* can be also referred to as "throat". As illustrated in FIGS. 2 and 3, the movable arc contact 21 is inserted into the opening 50*a* between the middle portion 50*m* and a thermal puffer chamber 25 with a gap therebetween. A passage 50*p* for an arc-extinguishing gas is configured by the gap between the middle portion 50*m* and the thermal puffer chamber 25. A diameter enlarged portion having a conical surface shape, whose diameter is enlarged as approaching toward the end is formed between the middle portion 50*m* and the end of the insulation nozzle 50 in the axial direction A. As illustrated in FIG. 3, a passage 50*s* for the arc-extinguishing gas between the middle portion 50*m* and the exhaust pipe 13 is configured by the diameter enlarged portion. The opening 50*a* is an example of a space.

The opposing energizing contact 12 is a cylindrical conductor and extends along the axial direction A around the central axis Ax. The opposing energizing contact 12 is bonded to an outer periphery of the other end of the exhaust pipe 13 in the axial direction A. An opening edge of the opposing energizing contact 12 in a longitudinal direction projects inward in the radial direction.

The movable energizing contact 22 is a cylindrical conductor and extends along the axial direction A around the central axis Ax. The movable contact portion 20 includes the cylindrical cylinder 23 that houses the operating rod 40. The movable energizing contact 22 is bonded to an end of the cylinder 23 in the axial direction A. The movable energizing contact 22 approaches the opposing energizing contact 12 with movement of the operating rod 40, and as illustrated in FIG. 1, is inserted into the opposing energizing contact 12. An inner diameter of the opening edge of the opposing energizing contact 12 and an outer diameter of the movable energizing contact 22 substantially coincide with each other, and the opposing energizing contact 12 and the movable energizing contact 22 are electrically connected with each other in a state with the movable energizing contact 22 being inserted into the opposing energizing contact 12.

In the configurations described above, in an open state subsequent to a connected state, as illustrated in FIGS. 2 and 3, arc discharge Ad is generated in the opening 50*a* of the insulation nozzle 50 between the opposing arc contact 11 and the movable arc contact 21. The generated arc discharge Ad is extinguished by flow of an arc-extinguishing gas. In the following descriptions, the flow of an arc-extinguishing gas can be simply referred to as "gas flow".

Gas flow is generated in the cylinder 23. The cylinder 23 is a cylindrical conductor and extends along the axial direction A around the central axis Ax. The cylinder 23 is fixed with the operating rod 40. That is, the cylinder 23 moves with movement of the operating rod 40.

An annular space is provided between the cylinder 23 and the operating rod 40. The annular space is separated in the axial direction A by a partition wall 24 extending in the radial direction to constitute the thermal puffer chamber 25 and a machine puffer chamber 26. Gas flow to be sprayed to the arc discharge Ad is generated in the thermal puffer chamber 25 and the machine puffer chamber 26. A plurality of through-holes 24*a* are provided in the partition wall 24. An arc-extinguishing gas can move in and out between the thermal puffer chamber 25 and the machine puffer chamber 26 via the through-holes 24*a*. The thermal puffer chamber 25 and the machine puffer chamber 26 are an example of a pressure accumulator, and can be also referred to as "pressure accumulator space".

In the thermal puffer chamber 25, pressure of the arc-extinguishing gas is increased by thermal energy generated by the arc discharge Ad between the opposing arc contact 11 and the movable arc contact 21 as illustrated in FIG. 2. Specifically, as illustrated by an arrow in FIG. 2, a pressure wave generated by the thermal energy of the arc discharge Ad is introduced into the thermal puffer chamber 25, thereby increasing the pressure in the thermal puffer chamber 25.

A piston 27 fixed to the airtight container 30 is located on an opposite side to the partition wall 24. The piston 27 is housed in the cylinder 23 slidably in the axial direction A relative to the cylinder 23 and the operating rod 40. As is obvious from comparison between FIGS. 2 and 3 and FIG. 1, when the cylinder 23 and the operating rod 40 move to the other side of the axial direction A, the distance between the partition wall 24 and the piston 27 decreases to decrease the capacity of the machine puffer chamber 26. Due to the decrease of the capacity of the machine puffer chamber 26, the pressure of the arc-extinguishing gas in the machine puffer chamber 26 is increased. A relief valve 28 that is opened by a pressure equal to or higher than a predetermined value is provided in the piston 27. An increase of the pressure to a predetermined value or higher in the machine puffer chamber 26 is suppressed by the relief valve 28.

As illustrated in FIG. 2, when arc discharge Ad is generated between the opposing arc contact 11 and the movable arc contact 21, the pressure wave of the arc-extinguishing gas is introduced into the thermal puffer chamber 25 via a passage 50*p* in the insulation nozzle 50, to increase the pressure in the thermal puffer chamber 25. Further, as described above, with the movement of the piston 27 relative to the cylinder 23 and the operating rod 40, the pressure in the machine puffer chamber 26 increases. As illustrated in FIG. 3, the arc-extinguishing gas in the machine puffer chamber 26 flows to the thermal puffer chamber 25 via the through-holes 24*a* in response to the increase of the pressure, acts on the arc discharge Ad via the passage 50*p* in the insulation nozzle 50 together with the arc-extinguishing gas in the thermal puffer chamber 25, to extinguish the arc discharge Ad.

The exhaust pipe 13 includes a cylindrical portion 13*a* and a conical portion 13*b*. The cylindrical portion 13*a* is located on the side of the axial direction A of the exhaust pipe 13. The conical portion 13*b* is located on the other side of the axial direction A of the exhaust pipe 13. The conical portion 13*b* is formed so as to become narrower gradually as approaching from the cylindrical portion 13*a* toward an end 13*c* on the side of the movable contact portion 20. The conical portion 13*b* can be also referred to as "diffuser".

As illustrated in FIG. 1 to FIG. 8, a shielding portion 19 is provided in the exhaust pipe 13. The shielding portion 19 includes a first shielding wall 14 and a second shielding wall 15. The first shielding wall 14 is formed in a disk shape being orthogonal to the axial direction A. The first shielding wall 14 can be also referred to as "shielding plate".

The second shielding wall 15 is formed in a cylindrical shape extending along the axial direction A around the central axis Ax. The second shielding wall 15 extends to the other side of the axial direction A from an outside end in the radial direction of the first shielding wall 14 toward the end 13*c* of the exhaust pipe 13. The second shielding wall 15 comes in contact with the end 13*c* of the exhaust pipe 13, that is, the opening edge. That is, a space between the second shielding wall 15 and the conical portion 13*b* is substantially blocked by the end 13*c*. The second shielding wall 15 can be in a tubular shape other than the cylindrical shape, and can be for example a tubular shape having a polygonal section. The second shielding wall 15 can be also referred to as "shielding tube".

A through-hole 15*a* is provided in the second shielding wall 15. Specifically, a plurality of the through-holes 15*a* are provided in the second shielding wall 15 along the axial direction A with a space therebetween. These through-holes 15*a* constitute a row along the axial direction A. According to the present embodiment, a plurality of rows including the through-holes 15*a* are provided with a space therebetween in a circumferential direction of the exhaust pipe 13. According to the present embodiment, as an example, three through-holes 15*a* (through-holes 15*a*1, 15*a*2, 15*a*3) are provided along the axial direction A in the respective rows. The through-hole 15*a*1 is provided adjacent to the first shielding wall 14. The through-hole 15*a*2 is located away from the first shielding wall 14 than the through-hole 15*a*1 and an opening area thereof is smaller than the through-hole 15*a*1. The through-hole 15*a*3 is located away from the first shielding wall 14 than the through-holes 15*a*1 and 15*a*2, and an opening area thereof is larger than the through-hole 15*a*2.

Figure 5:
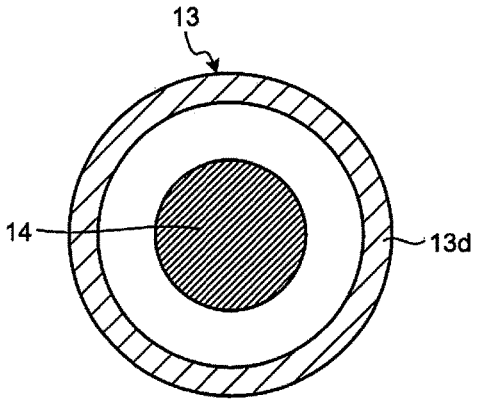
FIG. 5 is a diagram illustrating a V-V cross section of FIG. 4.
Figure 6:
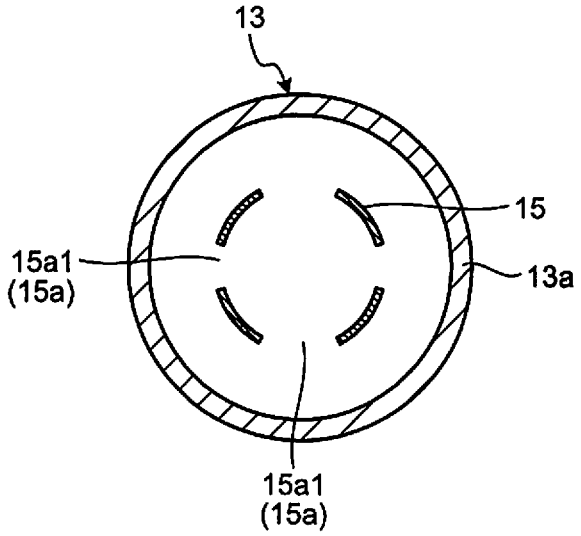
FIG. 6 is a diagram illustrating a VI-VI cross section of FIG. 4.
Figure 7:
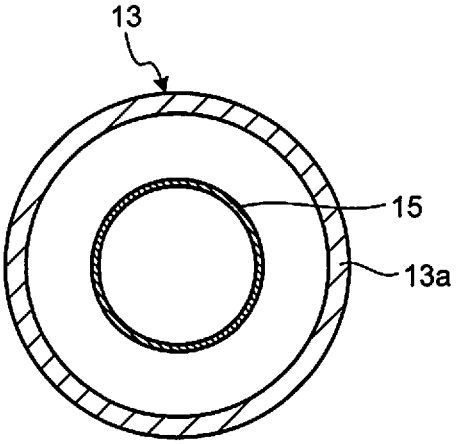
FIG. 7 is a diagram illustrating a VII-VII cross section of FIG. 4.
Figure 8:
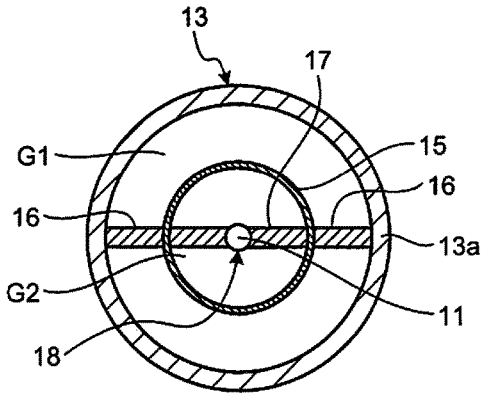
FIG. 8 is a diagram illustrating a VIII-VIII cross section of FIG. 4.

FIG. 5 to FIG. 8 illustrate a section orthogonal to the axial direction A of the shielding portion 19. Specifically, FIG. 5 illustrates a section of the first shielding wall 14. FIG. 6 illustrates a section of a portion of the through-hole 15*a* in the second shielding wall 15. FIG. 6 illustrates an example in which four through-holes 15*a* are provided in the circumferential direction. FIG. 7 illustrates a section of a portion where the through-hole 15*a* is not provided in the second shielding wall 15. FIG. 8 illustrates a section of a portion of the second shielding wall 15 supported by the exhaust pipe 13.

Figure 4:
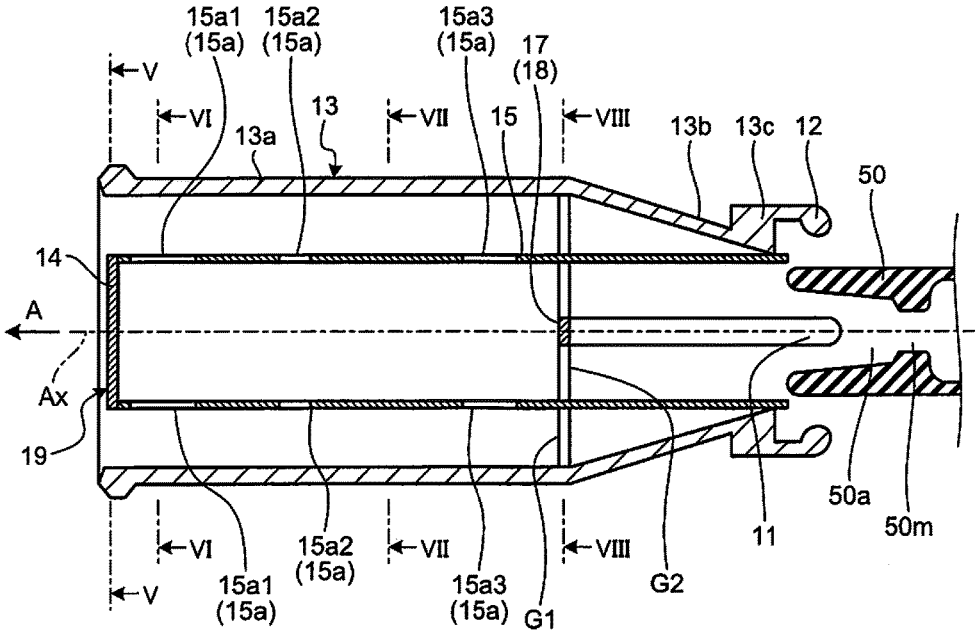
FIG. 4 is a partially enlarged diagram of FIG. 3.

As illustrated in FIG. 8, the second shielding wall 15 is supported by a support member 16 projecting from an inner surface of the exhaust pipe 13 toward inside in the radial direction in a state of having a gap G1 from the inner surface. According to the present embodiment, the second shielding wall 15 is supported by two support members 16. However, the number of support members 16 can be one or plural, which is three or more. A support member 17 is fixed to a part of the inner surface of the second shielding wall 15. The opposing arc contact 11 is fixed to the support member 17. That is, the opposing arc contact 11 is housed in the second shielding wall 15 and is supported by the second shielding wall 15 via the support member 17. The opposing arc contact 11 and the support member 17 constitute a structural object 18, at least a part of which is housed in the second shielding wall 15. A gap G2 is provided between the other part of the inner surface of the second shielding wall 15 and the support member 17. In FIG. 4, all the through-holes 15*a* are provided on the side of the axial direction A than the support member 17 (the support member 16). However, some of the through-holes 15*a* can be provided on the other side of the axial direction A than the support member 17 (the support member 16). The structural object 18 can be also referred to as "housing".

As is obvious from FIG. 1 to FIG. 3, the insulation nozzle 50 is inserted into the second shielding wall 15 and is moved along the axial direction A in the second shielding wall 15. Further, a relatively narrow clearance is provided between the inner surface of the second shielding wall 15 and an outer surface of the insulation nozzle 50. Accordingly, the arc-extinguishing gas is suppressed from leaking from a gap between the second shielding wall 15 and the insulation nozzle 50. The inner surface of the second shielding wall 15 is an example of a guide portion that guides the insulation nozzle 50.

The through-holes 15*a* are provided in the second shielding wall 15. An inside space of the second shielding wall 15 and an outside space of the second shielding wall 15 are connected via the through-holes 15*a*.

Therefore, as illustrated in FIG. 3, the arc-extinguishing gas from the insulation nozzle 50 passes from the inside space of the second shielding wall 15 and flows out to the outside space of the second shielding wall 15 via the gap G2 and the through-holes 15*a* in the exhaust pipe 13. Further, the arc-extinguishing gas flows to the inside space of the cylindrical portion 13*a* and flows out into the airtight container 30 from the end 13*d* of the exhaust pipe 13. At this time, the pressure in the thermal puffer chamber 25 and the machine puffer chamber 26 (pressure accumulator) is higher than the pressure in the insulation nozzle 50, and the pressure in the insulation nozzle 50 is higher than the pressure in the exhaust pipe 13.

At this time, the arc-extinguishing gas flowing into the second shielding wall 15 passes between the opposing arc contact 11 and the second shielding wall 15 at a supersonic speed. More specifically, according to the present embodiment, the arc-extinguishing gas passes between the structural object 18 and the second shielding wall 15 at a supersonic speed. After having passed between the structural object 18 including the opposing arc contact 11 and the second shielding wall 15, the arc-extinguishing gas passes through the second shielding wall 15 at a subsonic speed. This is because in a region in the axial direction A in the second shielding wall 15, a sectional area of a space, which becomes a passage of the arc-extinguishing gas, rapidly increases in a region where the structural object 18 is not provided than in a region where the structural object 18 is provided, and as a result, shock waves are generated, thereby decelerating to a subsonic speed. The arc-extinguishing gas at a subsonic speed flows into the through-holes 15*a*. In FIG. 3, the arc-extinguishing gas flows at a supersonic speed on the right side of a dot-and-dash line B, and flows at a subsonic speed on the left side of the dot-and-dash line B. Thus, the shielding portion 19 (the first shielding wall 14 and the second shielding wall 15) allows flow of the arc-extinguishing gas via the gaps G1, G2 and the through-holes 15*a* in the exhaust pipe 13. The gaps G1, G2 and the through-holes 15*a* are passages of the arc-extinguishing gas. It can be said that the gap G1 is an opening provided in a configuration including the support member 16, the second shielding wall 15, and the exhaust pipe 13. Further, it can be said that the gap G2 is an opening provided in a configuration including the support member 17 and the second shielding wall 15.

Next, the through-hole 15*a* is described in detail. If an opening area of the through-hole 15*a* provided in the second shielding wall 15 is too small, a sufficient amount of arc-extinguishing gas may not be able to flow out to the outside space of the second shielding wall 15. On the contrary, if the opening area of the through-hole 15*a* is too large, a vortex is likely to be generated at a portion of the through-hole 15*a*. If a vortex is generated, the flow stagnates in the vortex-generated portion and the state becomes the same as when the opening area of the through-hole 15*a* is small. Therefore, a sufficient amount of arc-extinguishing gas may not be able to flow out to the outside space of the second shielding wall 15.

Figure 9:
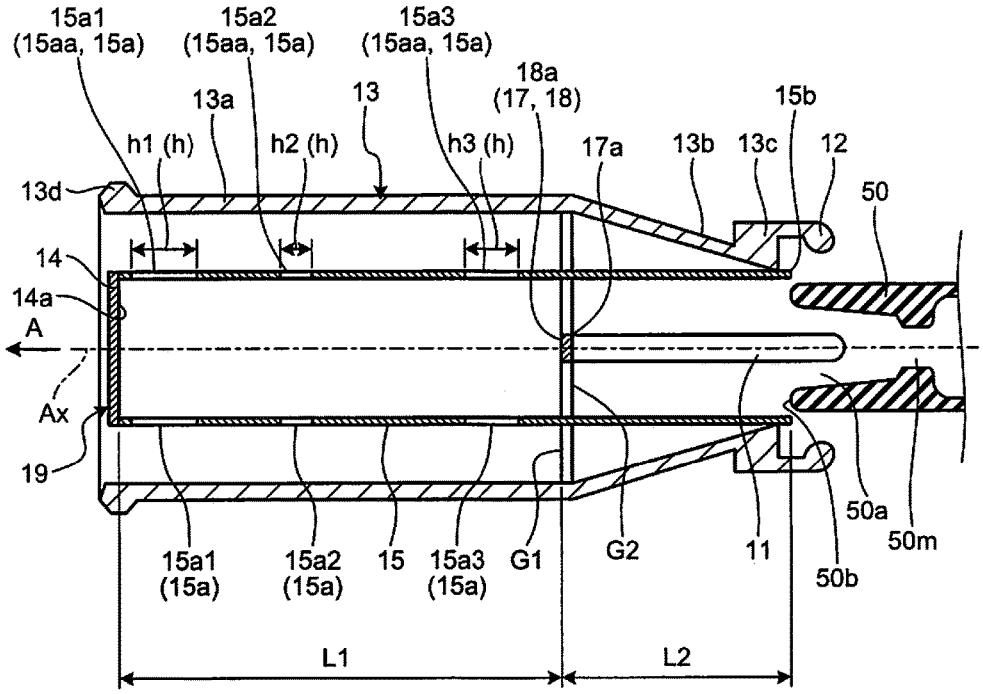
FIG. 9 is a partially enlarged diagram of FIG. 3 for explaining dimensions of respective parts of the gas circuit breaker.

Therefore, as illustrated in FIG. 9, the through-hole 15*a* is provided so that a length h (height) of the through-hole 15*a* along the axial direction A becomes 18 millimeters to 55 millimeters inclusive. Accordingly, a sufficient amount of arc-extinguishing gas can be caused to flow out to the outside space of the second shielding wall 15 via the through-hole 15*a* without causing a vortex. According to the present embodiment, lengths h1, h2, and h3 of the through-holes 15*a*1, 15*a*2, and 15*a*3 along the axial direction A are respectively set to a range from 18 millimeters to 55 millimeters inclusive. It is more preferable that the length h of the through-hole 15*a* along the axial direction A is from 20 millimeters to 50 millimeters inclusive.

Figure 10:
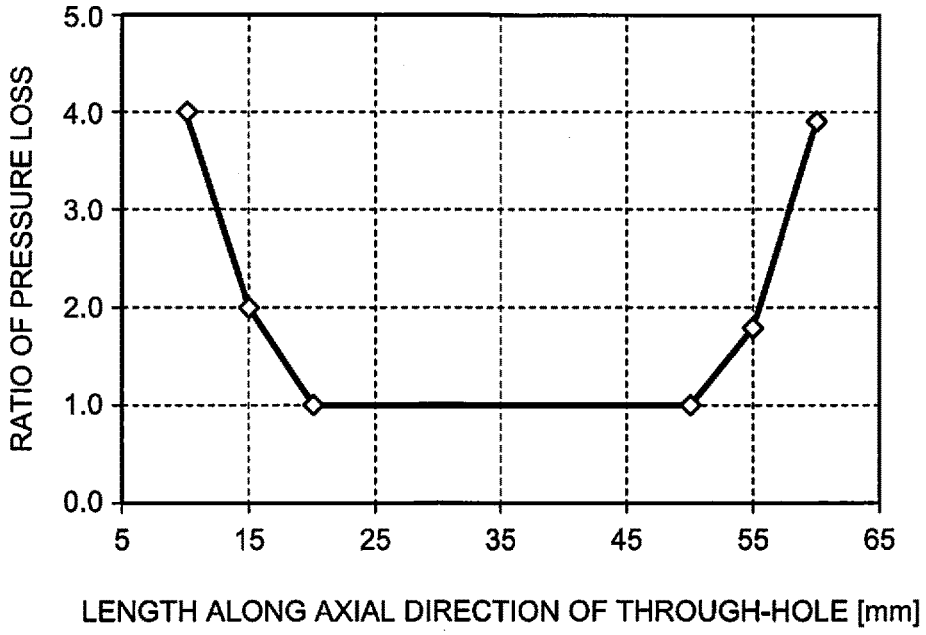
FIG. 10 is a diagram related to pressure loss of through-holes in the gas circuit breaker according to the embodiment.

FIG. 10 illustrates a correlation between the length h of the through-hole 15*a* along the axial direction A and a ratio of pressure loss. The length h of the through-hole 15*a* along the axial direction A is plotted on a horizontal axis, and the ratio of pressure loss is plotted on a vertical axis in FIG. 10. The ratio of pressure loss is a ratio of pressure loss of each through-hole 15*a* to pressure loss of a through-hole 15*a* having the length h in the axial direction A being 20 millimeters to 50 millimeters. As illustrated in FIG. 10, it has been found that when the length h of the through-hole 15*a* along the axial direction A is within the range described above, the pressure loss decreases. That is, it has been found that an arc-extinguishing gas at a high temperature smoothly flows out to the outside of the shielding portion 19 from the through-hole 15*a*.

Next, an opening area of the through-hole 15*a* is described with reference to FIG. 9. The opening area is an area of an opening end 15*aa* of the through-hole 15*a*1 as an example. First, opening areas of the respective through-holes 15*a*1, 15*a*2, and 15*a*3 when three through-holes 15*a*1, 15*a*2, and 15*a*3 are provided along the axial direction A in the second shielding wall 15 are described. It is assumed that the opening area of the through-hole 15*a*1 is S1, the opening area of the through-hole 15*a*2 is S2, the opening area of the through-hole 15*a*3 is S3, and the total of opening areas S1, S2, and S3 of the through-holes 15*a*1, 15*a*2, and 15*a*3 is S. At this time, the through-holes 15*a* are provided so that a value of S1/S, which is a ratio of an opening area S1 (i is a natural number from 1 to 3) of each through-hole 15*a* to the total area S becomes S1/S=0.45±0.05, S2/S=0.23±0.05, and S3/S=0.32±0.05. The area ratio has a margin of 5%, as indicated by ±0.05. By providing this margin, a sufficient amount of arc-extinguishing gas can be caused to flow out to the outside space of the second shielding wall 15 without generating a vortex.

Next, a case where n through-holes 15*a* (n is a natural number of 3 or more) are provided sequentially toward the other side of the axial direction A along the axial direction A is described. It is assumed that the opening area of the through-hole 15*a*1 is S1, the opening area of the through-hole 15*a*2 is S2, the opening area of the through-hole 15*an* is Sn, and the total of opening areas of the through-holes 15*a*1 to 15*an* is S. At this time, based on a case where there are three through-holes 15*a*, it is assumed that S1 is S×(0.45×3/n±0.05), and similarly, Sn is S×(0.32×3/n±0.05). The remaining through-holes 15*a* excluding S1 and Sn are assumed that S2 to Sn−1 have the same opening area and are S×((1−2.31/n)/(n−2)±0.05). The through-holes 15*a* are provided so that a ratio S1/S of the opening area S1 of each through-hole 15*a* to the total area S respectively becomes S1/S=0.45×3/n±0.05, S2/S=(1−2.31/n)/(n−2)±0.05, Sn−1/S=(1−2.31/n)/(n−2)±0.05, Sn/S=0.32×3/n±0.05. The area ratio has a margin of 5%, as indicated by ±0.05. By providing this margin, a sufficient amount of arc-extinguishing gas can be caused to flow out to the outside space of the second shielding wall 15 without generating a vortex.

Figure 11:
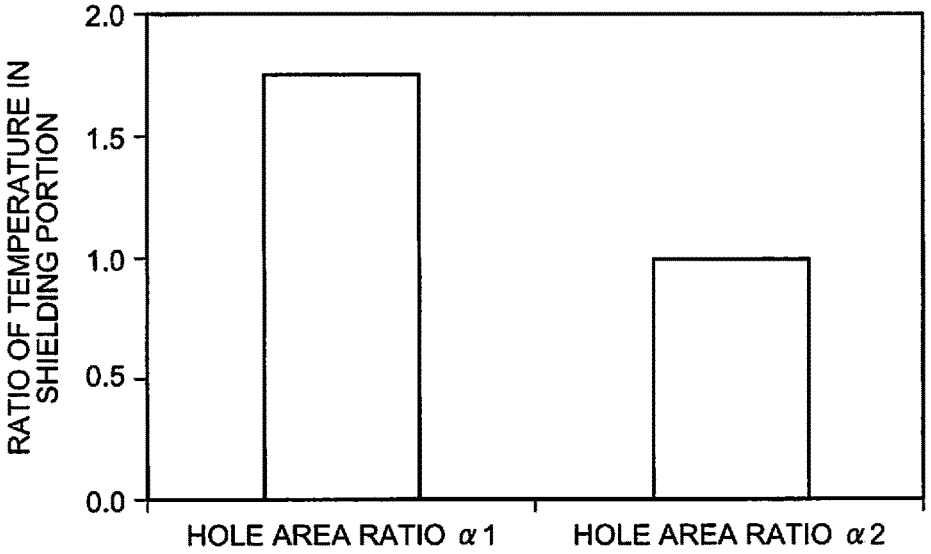
FIG. 11 is a diagram related to the temperature in a shielding portion in the gas circuit breaker according to the embodiment.

FIG. 11 illustrates a correlation between an opening area ratio of the through-hole 15*a* and a temperature ratio in the shielding portion 19. The opening area ratio of the through-hole 15*a* is plotted on a horizontal axis in FIG. 11. The opening area ratio is a ratio among the opening area S1 of the through-hole 15*a*1, the opening area S2 of the through-hole 15*a*2, and the opening area S3 of the through-hole 15*a*3. A hole area ratio α1 in FIG. 11 is for a case where S1:S2:S3=4:3:3. A hole area ratio α2 in FIG. 11 is for a case where S1:S2:S3=45:23:32. The temperature ratio in the shielding portion 19 is plotted on a vertical axis in FIG. 11. The temperature in the shielding portion 19 is, as an example, an average temperature in the shielding portion 19. The temperature ratio is a ratio of the temperature in the shielding portion 19 having the hole area ratio α1, α2 respectively to the temperature in the shielding portion 19 having the hole area ratio α2. As illustrated in FIG. 11, by setting the ratio of the opening areas among the respective through-holes 15*a* as described above, it has been found that the temperature in the shielding portion 19 decreases. That is, it has been found that a high-temperature arc-extinguishing gas flows to the outside of the shielding portion 19 smoothly from the through-holes 15*a*.

Next, a dimension of the capacity of a space inside of the second shielding wall 15 is described with reference to FIG. 9. It is assumed here that a length between an end 14*a* (end face) of the first shielding wall 14 on the side of the structural object 18 and an end 18*a* of the structural object 18 on the side of the first shielding wall 14 along the axial direction A is L1, and a length between an end 50*b* of the insulation nozzle 50 on the side of the first shielding wall 14 (on the side of the structural object 18 and the first shielding wall 14) and the end 18*a* of the structural object 18 on the side of the first shielding wall 14 along the axial direction A, in a state where the movable arc contact 21 and the opposing arc contact 11 are furthermost opened (separated) in the axial direction A, is L2. The lengths are set to be L1>L2. Accordingly, for example, the inside space of the second shielding wall 15 required for mixing a high-temperature arc-extinguishing gas heated by the thermal energy of the arc discharge Ad with a low-temperature arc-extinguishing gas to cool the arc-extinguishing gas sufficiently can be easily ensured. Further, in this case, it is preferable to set the length L1 to be about 1.2 times the length of L2, taking into consideration the size of the through-holes 15*a* and the area ratio among the through-holes 15*a*. The end 18*a* of the structural object 18 on the side of the first shielding wall 14 is an end of the support member 17 in the configuration of the present embodiment. Further, such a configuration is possible that the end 18*a* of the structural object 18 on the side of the first shielding wall 14 is an end of the opposing arc contact 11. Further, a length from an end 17*a* of the support member 17 on the other side of the axial direction A to an end 15*b* of the second shielding wall 15 on the other side of the axial direction A along the axial direction A can be set as L2, so that L1>L2. The end 17*a* of the support member 17 can be also referred to as "end of the support member 17*b* on the opposite side to the first shielding wall 14". Further, the end 15*b* of the second shielding wall 15 can be also referred to as "end of the second shielding wall 15 on the opposite side to the first shielding wall 14".

Figure 12:
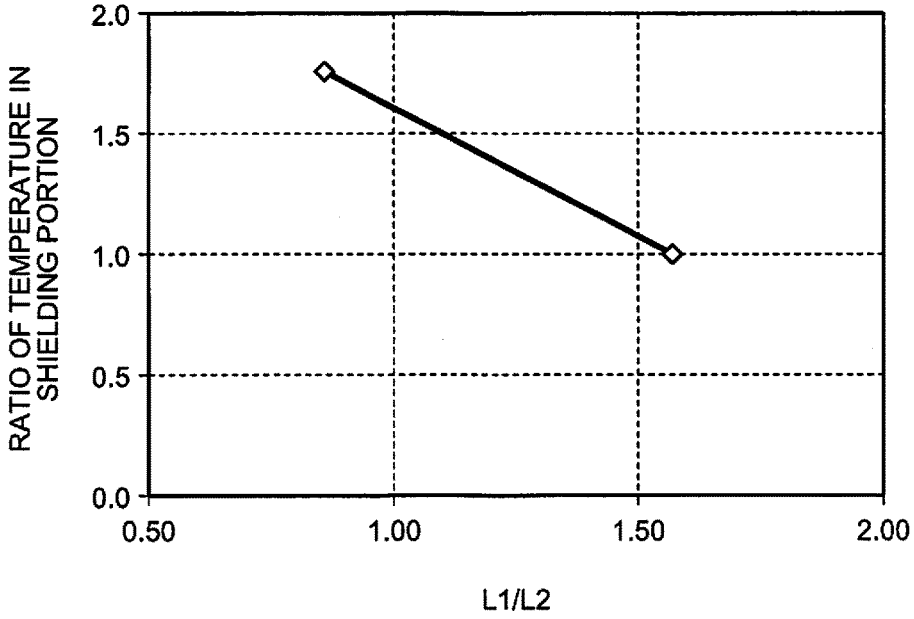
FIG. 12 is a diagram related to the temperature in the shielding portion in the gas circuit breaker according to the embodiment.

FIG. 12 illustrates a correlation between L1/L2 (length ratio) and the temperature ratio in the shielding portion 19. L1/L2 is plotted on a horizontal axis in FIG. 12. The temperature ratio in the shielding portion 19 is plotted on a vertical axis in FIG. 12. The temperature in the shielding portion 19 is, as an example, an average temperature in the shielding portion 19. The temperature ratio is a ratio of the temperature in the shielding portion 19 respectively at L1/L2 to the temperature in the shielding portion 19 in a case of L1/L2=1.57. As illustrated in FIG. 12, by setting the lengths to be L1>L2, it has been found that the temperature in the shielding portion 19 decreases. That is, it has been found that a high-temperature arc-extinguishing gas is mixed with a low-temperature arc-extinguishing gas to decrease the temperature of the arc-extinguishing gas sufficiently.

Figure 13:
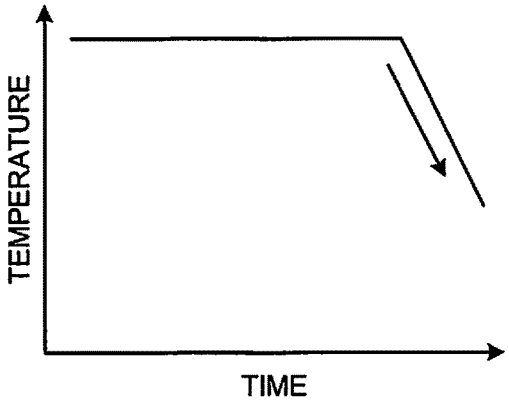
FIG. 13 is a diagram illustrating a time history of the temperature near an opposing arc contact in the gas circuit breaker according to the embodiment.

FIG. 13 illustrates a time history of the temperature near the opposing arc contact 11. A time (elapsed time) is plotted on a horizontal axis, and the temperature near the opposing arc contact 11 is plotted on a vertical axis in FIG. 13. FIG. 13 illustrates a result of numerical simulation of the time history of the temperature near the opposing arc contact 11 under a condition that a current value of an interrupting current is large in a case where the length L1 is about 1.2 times the length of L2. It can be understood from FIG. 13 that by spraying an arc-extinguishing gas to the arc discharge Ad to cause the arc-extinguishing gas to flow out into the airtight container 30 from a high-temperature state due to the generation of the arc discharge Ad, the temperature has decreased rapidly, thereby interrupting the current.

Further, in the conventional gas circuit breaker, if an arc-extinguishing gas rapidly flows into the exhaust pipe 13 from the insulation nozzle 50, the pressure of the arc-extinguishing gas rapidly increases in the exhaust pipe 13, to generate a pressure wave. If smooth flow of the arc-extinguishing gas is blocked due to the pressure wave, extinguishing of the arc discharge Ad by the arc-extinguishing gas may not be performed more smoothly or reliably. In this regard, according to the present embodiment, because the first shielding wall 14 and the second shielding wall 15 operate as resistant elements of the gas flow appropriately, a rapid increase of the pressure in the exhaust pipe 13 can be suppressed and generation of the pressure wave and propagation thereof to near the arc contact can be mitigated, as compared to a case where the first shielding wall 14 and the second shielding wall 15 are not provided. Further, according to the present embodiment, a bent passage of an arc-extinguishing gas is formed in the exhaust pipe 13 by the first shielding wall 14 and the second shielding wall 15. Therefore, the first shielding wall 14 and the second shielding wall 15 can be also referred to as "bent-passage forming portion" or "labyrinth forming portion". The plate-like first shielding wall 14 only needs to intersect with the axial direction A within a range capable of obtaining the effect thereof, and does not need to intersect with the axial direction A completely. Further, the cylindrical second shielding wall 15 only needs to be along the axial direction A within a range capable of obtaining the effect thereof, and does not need to be constant in the entire range in which the sectional shape and the diameter are along the axial direction A.

In the configurations described above, gas flow initially having reached inside of the exhaust pipe 13 from the insulation nozzle 50 flows from the inside of the second shielding wall 15 to the outside of the second shielding wall 15 via the through-holes 15*a*. According to the present embodiment, because the length h (height) of the through-hole 15*a* along the axial direction A is within a range from 18 millimeters to 55 millimeters, generation of a vortex is mitigated at the edge of the through-hole 15*a*, and the gas flow can flow out more smoothly to the outside of the second shielding wall 15 via the through-holes 15*a* without decreasing a substantial flow-passage sectional area of the through-holes 15*a* due to the vortex. Therefore, according to the present, embodiment, extinguishing of the arc discharge Ad by an arc-extinguishing gas can be performed more reliably or more efficiently.

Further, if the current value of an interrupting current is large, the pressure ratio between the thermal puffer chamber 25 and the exhaust pipe 13 may become too large to block smooth exhaust of the arc-extinguishing gas. Further, if a gas flow rate from the insulation nozzle 50 to the exhaust pipe 13 increases, pressure is likely to increase in a region close to the first shielding wall 14 inside of the second shielding wall 15. Meanwhile, according to the present embodiment, n through-holes 15*a* (n is a natural number of 3 or more) are provided along the axial direction A with a space therebetween in the second shielding wall 15. The ratio of the opening area S1 of the through-hole 15*a*1 closest to the first shielding wall 14, of the n through-holes 15*a*, to the total (total area) of respective opening areas S1 of the n through-holes 15*a* is $0.45\times3/n\pm0.05$. The ratio of the opening area S3 of the through-hole 15*a*3 closest to the opposing arc contact 11, of the n through-holes 15*a*, to the total of the respective opening areas S1 is $0.32\times3/n\pm0.05$. Further, the ratio of the opening area S2 of the through-hole 15*a*2 provided between the through-hole 15*a*1 closest to the first shielding wall 14 and the through-hole 15*a*3 closest to the opposing arc contact 11, of the n through-holes 15*a*, to the total of respective opening areas S1 is $(1-2.31/n)/(n-2)\pm0.05$. Accordingly, the gas flow can flow out to the outside of the second shielding wall 15 more smoothly via the through-holes 15*a*. Consequently, according to the present embodiment, extinguishing of the arc discharge Ad by an arc-extinguishing gas can be performed more reliably or more efficiently.

Further, according to the present embodiment, the opposing arc contact 11 is housed in the second shielding wall 15 and is supported by the second shielding wall 15 via the support member 17. The opposing arc contact 11 and the support member 17 constitute the structural object 18. The length L1 between the end 14*a* of the first shielding wall 14 on the side of the structural object 18 and the end 18*a* of the structural object 18 on the side of the first shielding wall 14 along the axial direction A is longer than the length L2 between the end 50*b* of the insulation nozzle 50 on the side of the first shielding wall 14 and the end 18*a* of the structural object 18 on the side of the first shielding wall 14 along the axial direction A, in a state in which the movable arc contact 21 and the opposing arc contact 11 are furthermost separated (open) from each other in the axial direction A. Accordingly, a high-temperature arc-extinguishing gas heated by the thermal energy of the arc discharge Ad is mixed with a low-temperature arc-extinguishing gas, thereby enabling to cool the arc-extinguishing gas sufficiently. Therefore, according to the present embodiment, extinguishing of the arc discharge Ad by an arc-extinguishing gas can be performed more reliably or more efficiently.

Further, according to the present embodiment, an arc-extinguishing gas flowing into the second shielding wall 15 passes between the opposing arc contact 11 and the second shielding wall 15 at a supersonic speed. After having passed between the opposing arc contact 11 and the second shielding wall 15, the arc-extinguishing gas passes through the second shielding wall 15 at a subsonic speed, and flows into the through-holes 15*a*. Accordingly, because the arc-extinguishing gas flows into the through-holes 15*a* at a subsonic speed, pressure loss can be reduced as compared to a case where the arc-extinguishing gas flows into the through-holes 15*a* at a supersonic speed. Therefore, according to the present embodiment, extinguishing of the arc discharge Ad by an arc-extinguishing gas can be performed more reliably or more efficiently.

Further, according to the present embodiment, the second shielding wall 15 functions as the guide portion that guides the insulation nozzle 50 in the axial direction A. Therefore, according to the present embodiment, it can be suppressed that the insulation nozzle 50 is deviated from the central axis Ax or is inclined. Further, according to the present embodiment, the insulation nozzle 50 is housed in the second shielding wall 15 movably in the axial direction A with a clearance therebetween. Therefore, for example, by setting the clearance to be relatively narrow such as several micrometers in a diameter difference, leakage of an arc-extinguishing gas along an outer periphery of the insulation nozzle 50 can be suppressed. Therefore, according to the present embodiment, extinguishing of the arc discharge Ad by an arc-extinguishing gas can be performed more reliably or more efficiently.

Further, by the configuration of the gas circuit breaker as described above, the following problem can be solved. That is, if the pressure distribution does not exhibit a monotonous decrease, for example, pressure increases in the middle from the thermal puffer chamber 25 toward a downstream space, and propagation of a pressure wave generated by the arc discharge Ad toward the opposing arc contact 11, and back current or stagnation of the arc-extinguishing gas occur. Consequently, a problem such that outflow of an arc-extinguishing gas is blocked may occur. Such a problem can be solved by the configuration of the gas circuit breaker as described above. Further, by the configuration of the gas circuit breaker as described above, smooth outflow of a high-temperature gas at the time of current cutoff can be realized. Further, by the configuration of the gas circuit breaker as described above, a gas circuit breaker having excellent current cutoff performance can be provided in any current region.

According to the embodiment described above, a case where only the movable contact portion 20 can move in the axial direction A with respect to the airtight container 30 has been illustrated. However, the present invention is not limited thereto. For example, also the opposing contact portion 10 can be configured to be movable in the axial direction A. Further, the thermal puffer chamber 25 and the machine puffer chamber 26 can be integrated with each other, or only one of the thermal puffer chamber 25 and the machine puffer chamber 26 can be provided.

According to the embodiment described above, for example, an example of the configuration in which the opposing contact portion 10 is fixed and only the movable contact portion 20 is moved along the axial direction A has been illustrated. However, the present invention is not limited thereto. For example, a so-called "dual motion mechanism" in which the opposing contact portion 10 is also moved along the axial direction A so that the movable contact portion 20 relatively moves with respect to the opposing contact portion 10 to improve the relative pole (contact portion) opening rate can be used.

Further, according to the embodiment described above, an example of the gas circuit breaker 1 having a configuration in which the thermal puffer chamber 25 being a pressure accumulator space by means of the action of the thermal energy of the arc discharge Ad and the machine puffer chamber 26 being a pressure accumulator space by means of the mechanical action of the drive system are separated by the partition wall 24 and are communicated with each other via the through-holes 24*a* provided in the partition wall 24 has been illustrated. However, the present invention is not limited thereto. For example, a configuration in which the thermal puffer chamber 25 and the machine puffer chamber 26 are not separated and pressure accumulation is performed by the action of the thermal energy and the mechanical action in the same puffer chamber, a configuration in which pressure accumulation is performed only by the action of the thermal energy, or a configuration in which pressure accumulation is performed only by the mechanical action can be used.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A gas circuit breaker comprising:

a container filled with an arc-extinguishing gas;

a movable portion housed in the container, which includes a movable arc contact and is provided with a pressure accumulator that increases pressure of the arc-extinguishing gas;

an opposing portion housed in the container and including an opposing arc contact, an exhaust pipe, and a shielding portion provided in the exhaust pipe in a state of allowing flow of the arc-extinguishing gas in the exhaust pipe; and a nozzle housed in the container and provided with a space in which arc discharge is generated between the movable arc contact and the opposing arc contact, wherein the shielding portion includes a first shielding wall intersecting with an axial direction of the exhaust pipe, and a second shielding wall having a cylindrical shape extending from the first shielding wall toward the movable portion along the axial direction of the exhaust pipe, the second shielding wall is provided with a plurality of through-holes with a space therebetween along the axial direction, a length of each of the through-holes along the axial direction is from 18 millimeters to 55 millimeters inclusive, and the arc-extinguishing gas whose pressure has been increased in the pressure accumulator flows into the space to extinguish the arc discharge, and flows into the second shielding wall.

2. The gas circuit breaker according to claim 1, wherein the second shielding wall is provided with n through-holes (n is a natural number of 3 or more) with the space therebetween along the axial direction, a ratio of an opening area of the through-hole closest to the first shielding wall, of the n through-holes, to a total of respective opening areas of the n through-holes is $0.45\times3/n\pm0.05$, a ratio of an opening area of the through-hole closest to the opposing arc contact, of the n through-holes, to the total of respective opening areas is $0.32\times3/n\pm0.05$, and a ratio of an opening area of the through-hole provided between the through-hole closest to the first shielding wall and the through-hole closest to the opposing arc contact, of the n through-holes, to the total of respective opening areas is $(1-2.31/n)/(n-2)\pm0.05$.

3. The gas circuit breaker according to claim 2, wherein the opposing arc contact is housed in the second shielding wall and supported by the second shielding wall via a support member, the opposing arc contact and the support member constitute a structural object, and a length between an end of the first shielding wall on a side of the structural object and an end of the structural object on a side of the first shielding wall along the axial direction is longer than a length between an end of the nozzle on the side of the first shielding wall and the end of the structural object on the side of the first shielding wall along the axial direction, in a state with the movable arc contact and the opposing arc contact being furthermost separated from each other in the axial direction.

4. The gas circuit breaker according to claim 2, wherein the n is 3.

5. The gas circuit breaker according to claim 1, wherein the opposing arc contact is housed in the second shielding wall and supported by the second shielding wall via a support member, the opposing arc contact and the support member constitute a structural object, and a length between an end of the first shielding wall on a side of the structural object and an end of the structural object on a side of the first shielding wall along the axial direction is longer than a length between an end of the nozzle on the side of the first shielding wall and the end of the structural object on the side of the first shielding wall along the axial direction, in a state with the movable arc contact and the opposing arc contact being furthermost separated from each other in the axial direction.

6. A gas circuit breaker comprising:

a container filled with an arc-extinguishing gas;

a movable portion housed in the container, which includes a movable arc contact and is provided with a pressure accumulator that increases pressure of the arc-extinguishing gas;

an opposing portion housed in the container and including an opposing arc contact, an exhaust pipe, and a shielding portion provided in the exhaust pipe in a state of allowing flow of the arc-extinguishing gas in the exhaust pipe; and a nozzle housed in the container and provided with a space in which arc discharge is generated between the movable arc contact and the opposing arc contact, wherein the shielding portion includes a first shielding wall intersecting with an axial direction of the exhaust pipe, and a second shielding wall having a cylindrical shape extending from the first shielding wall toward the movable portion along the axial direction of the exhaust pipe, the second shielding wall is provided with n through-holes (n is a natural number of 3 or more) with a space therebetween along the axial direction, a ratio of an opening area of the through-hole closest to the first shielding wall, of the n through-holes, to a total of respective opening areas of the n through-holes is $0.45\times3/n\pm0.05$, a ratio of an opening area of the through-hole closest to the opposing arc contact, of the n through-holes, to the total of respective opening areas is $0.32\times3/n\pm0.05$, a ratio of an opening area of the through-hole provided between the through-hole closest to the first shielding wall and the through-hole closest to the opposing arc contact, of the n through-holes, to the total of respective opening areas is $(1-2.31/n)/(n-2)\pm0.05$, and the arc-extinguishing gas whose pressure has been increased in the pressure accumulator flows into the space to extinguish the arc discharge, and flows into the second shielding wall.

7. The gas circuit breaker according to claim 6, wherein the opposing arc contact is housed in the second shielding wall and supported by the second shielding wall via a support member, the opposing arc contact and the support member constitute a structural object, and a length between an end of the first shielding wall on a side of the structural object and an end of the structural object on a side of the first shielding wall along the axial direction is longer than a length between an end of the nozzle on the side of the first shielding wall and the end of the structural object on the side of the first shielding wall along the axial direction, in a state with the movable arc contact and the opposing arc contact being furthermost separated from each other in the axial direction.

8. The gas circuit breaker according to claim 6, wherein the n is 3.

* * * * *